United States Patent [19]

Ohno

[11] Patent Number: 4,665,970

[45] Date of Patent: May 19, 1987

[54] METHOD OF PRODUCING A METALLIC MEMBER HAVING A UNIDIRECTIONALLY SOLIDIFIED STRUCTURE

[75] Inventor: Atsumi Ohno, Chofu, Japan

[73] Assignee: O.C.C. Company Limited, Tokyo, Japan

[21] Appl. No.: 800,040

[22] Filed: Nov. 20, 1985

[51] Int. Cl.[4] ..... B22D 27/02

[52] U.S. Cl. ..... 164/471; 164/493; 164/122.1; 164/122.2; 75/65 ZM; 156/616 R

[58] Field of Search ..... 164/122, 122.1, 122.2, 164/250.1, 471, 492–494, 505–507, 512–513; 75/65 ZM; 156/616 R, 620

[56] References Cited

U.S. PATENT DOCUMENTS

| | | | |
|---|---|---|---|
| 3,809,145 | 5/1974 | Kuhlmann-Schäffer | 164/492 |
| 4,546,811 | 10/1985 | Potard | 75/65 ZM |
| 4,563,558 | 1/1986 | Rhemer et al. | 164/493 |
| 4,573,516 | 3/1986 | Quested et al. | 164/122.1 |

*Primary Examiner*—Nicholas P. Godici
*Assistant Examiner*—Richard K. Seidel
*Attorney, Agent, or Firm*—William J. Daniel

[57] ABSTRACT

A metallic material is passed through a heating mold having a melting zone to produce a metallic member having a unidirectionally solidified structure.

14 Claims, 6 Drawing Figures

METHOD OF PRODUCING A METALLIC MEMBER HAVING A UNIDIRECTIONALLY SOLIDIFIED STRUCTURE

BACKGROUND OF THE INVENTION

1. Field of the Invention:

This invention relates to a method of producing a metallic member having a unidirectionally solidified structure and in the form of a wire, bar or sheet, or of any other desired cross sectional shape. More particularly, it is concerned with a method which produces a metallic member having a unidirectionally solidified structure by passing through a heating mold having a melting zone a metallic material prepared by casting or plastic working and having a length which is considerably greater than its diameter or thickness, such as a metal wire, bar or sheet.

2. Description of the Prior Art:

With its rapid growth, the electronic industry has incessantly been calling for still smaller and more precise machines and devices. They require metallic materials which are still smaller in thickness or diameter, and which are still better in quality. More specifically, they require thinner wires, sheets and foils formed from a material having a unidirectionally solidified structure, and which is free from any cavity or blowhole, and any grain boundary where impurities are likely to gather.

It is generally known that if a metallic material is subjected to cold working, such as rolling or drawing, it hardens and is eventually likely to fracture or crack at a primary crystal grain boundary which is formed in the casting process. Therefore, it is highly desirable to use a metallic material having a structure free from any such grain boundary in order to make a wire, sheet or foil which is extremely small in diameter or thickness.

There is known a method which is called zone melting, and which has primarily been developed for refining a metal. This method employs an elongated refractory vessel having a horizontal groove and called a boat. A metal ingot in the form of a bar is placed in the boat. Heat is applied from the outside of the boat by, for example, a resistance heater, gas burner or high-frequency induction coil to melt the ingot locally, and the melted portion of the metal is moved in one direction. This method not only refines the ingot, but can also produce an ingot having a unidirectionally solidified structure. The length of the ingot which this method can produce is, however, limited by the boat. It is incapable of making continuously an elongated ingot having a desired cross sectional shape and a unidirectionally solidified structure.

In order to produce an ingot in the form of a bar having a unidirectionally solidified structure, such as for a cast magnet, it has often been the case to place a metal bar vertically, heat it by a zone melting furnace having a resistance heater not contacting the bar, or a high-frequency induction coil to melt it locally, and move the melted portion of the bar upwardly or downwardly. This method does not employ any mold, but relies upon the surface tension of the molten metal to maintain the shape of the melted bar surface. The solidifed metal fails to retain the original smooth surface of the bar and has an uneven surface which has to be ground or polished before the bar can be used for making any product.

SUMMARY OF THE INVENTION

It is an object of this invention to provide a method which can very easily overcome the drawbacks of the prior art as hereinabove pointed out, and make a metallic product having a unidirectionally solidified structure which imparts a high degree of workability and/or good magnetic properties thereto, while removing therefrom any cavities, blowholes and other internal defects that have been formed during the casting of an ingot.

According to this invention, a metallic material is continuously or intermittently fed into a heating mold having a melting zone through one end thereof and melted in the melting zone. The melted material is caused to solidify within the mold having an inner wall surface heated to a temperature which is higher than that of the metallic material contacting it, so that no nucleation of any new crystal may take place on the inner wall surface of the mold from its melting zone and the other or outlet end thereof. Thus, a metallic member having a unidirectionally solidified structure can be easily produced through the outlet end of the mold. The term "outlet end" of the mold not only means its outer extremity, but also covers the area where the solidified metal leaves the inner wall surface of the mold as in case of using diversified mold.

It is desirable that there should not be any friction between the inner wall surface of the mold extending from its melting zone to its outlet end and the solidified metal. It is possible to avoid any such friction causing scratches on the solidified metal if the mold is so heated that the inner wall surface of the mold adjacent to its outlet end may be held at a temperature higher than the solidifying temperature of the metal to form on the metal surface a thin film of molten metal which is allowed to solidify upon leaving the outlet end of the mold. This method facilitates the production of a metallic member having a unidirectionally solidified structure and a mirror surface.

The melting zone is located adjacent to the outlet of the mold. The mold is so heated that its inner wall surface adjacent to its outlet end may have a temperature higher than the solidifying temperature of the metal, but very close thereto, while the metal is forcibly cooled outwardly of the outlet end of the mold so as to have a convexly projecting solidified end. The molten metal does not solidify on the inner wall surface of the mold at the outlet end thereof, but solidifies preferentially in its central portion. Therefore, no impurity or gas is trapped in the center of the metal. As shown in FIG. 1, the partly solidified metal S is covered by a very thin film F of molten metal M and finishes solidifying immediately after leaving the mold 1. Therefore, the solidified metal is not brought into frictional contact with the inner wall surface of the mold. This greatly facilitates the continuous production of a metallic member having a smooth and beautiful surface.

According to this invention, it is possible to produce a metallic member having a unidirectionally solidified structure continuously only if a polycrystalline metallic material prepared by casting or plastic deformation working and having a structure not regularly oriented is passed through a heating mold having a melting zone.

DETAILED DESCRIPTION OF THE INVENTION

Figure 1:
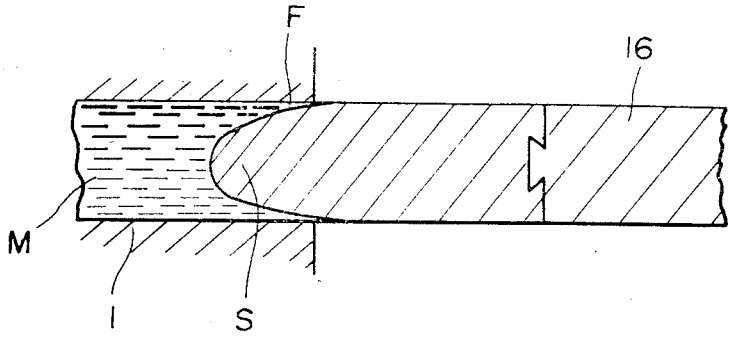
FIG. 1 is an enlarged partially sectional view of an apparatus showing the principle of the method of this invention.
Figure 2:
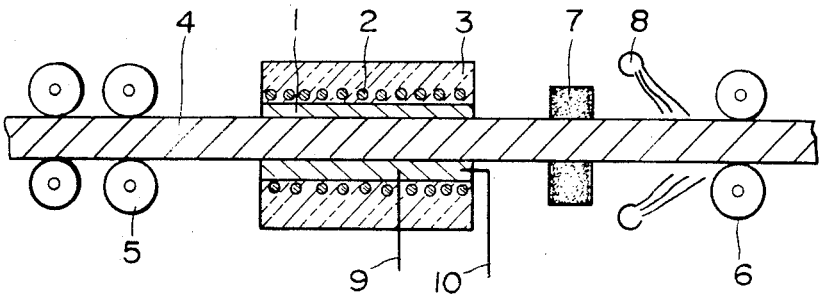
FIG. 2 is a front elevational and longitudinal sectional view of an apparatus which can be employed for carrying out the method of this invention.

Referring to FIG. 2, there is shown by way of example an apparatus which can be employed for producing a metallic member having a unidirectionally solidified structure continuously in accordance with the method of this invention. The apparatus comprises a heating mold 1 formed from graphite or refractories and an electric resistance heater or high-frequency induction coil 2 surrounding the mold 1. The heater or coil 2 is surrounded by a heat insulating material 3. The apparatus is adapted to treat an elongated metallic material 4 having a structure composed of a multiplicity of irregularly directed crystals, as shown in FIG. 2, or a plurality of like metallic materials 4 joined longitudinally one after another. A plurality of pairs of pinch rolls 5 and 6 are provided for conveying the metallic material or materials 4 through the mold 1. A guide 7 is provided for preventing the vibration of the metallic material or materials 4. The guide 7 is formed from graphite or refractories. A spray device 8 is provided for jetting out a cooling agent, such as water, mist, air or gas, against a metallic member leaving the mold 1. Thermocouples 9 and 10 are provided for measuring the temperature of the mold 1.

Figure 3:
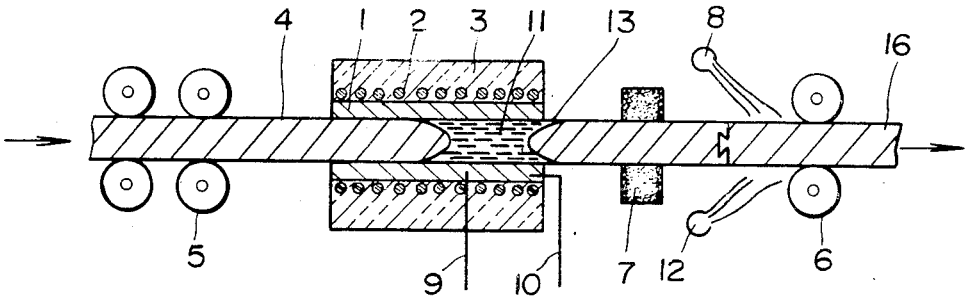
FIG. 3 is a view similar to FIG. 2, and illustrating a method embodying this invention.

An electric current is supplied to the heater 2 to heat the metallic material 4 in the mold 1 and melt it in a melting zone 11, as shown in FIG. 3. Then, the pinch rolls 5 and 6 are rotated to move the metallic material in the direction of an arrow in FIG. 3. If the inner wall surface of the mold 1 at the outlet end thereof is heated to a temperature which is higher than, but very close to, the solidifying temperature of the metallic material, the metal which has been melted in the mold 1 begins to solidify at the outlet end of the mold 1 and forms a metallic member 12 having a unidirectionally solidified structure. The metallic member 12 is drawn by the pinch rolls 6 in the direction of an arrow in FIG. 3. Insofar as the temperature of the inner wall surface of the mold at the outlet end thereof is higher than, but very close to, the solidifying temperature of the metallic material, there is a delay in the solidification of the metal forming a surface layer of the metallic member, and if the member has a small cross sectional area, it has a rounded solidifying end projecting into the mold 1. Therefore, it is possible to prevent any solute segregation or gas confinement in the center of the metallic member 12. The metallic member 12 has a film 13 of molten metal on its surface when leaving the mold 1 and this molten metal is allowed to solidify immediately after it has left the mold. Therefore, the metallic member 12 has a very smooth and beautiful surface.

Figure 4:
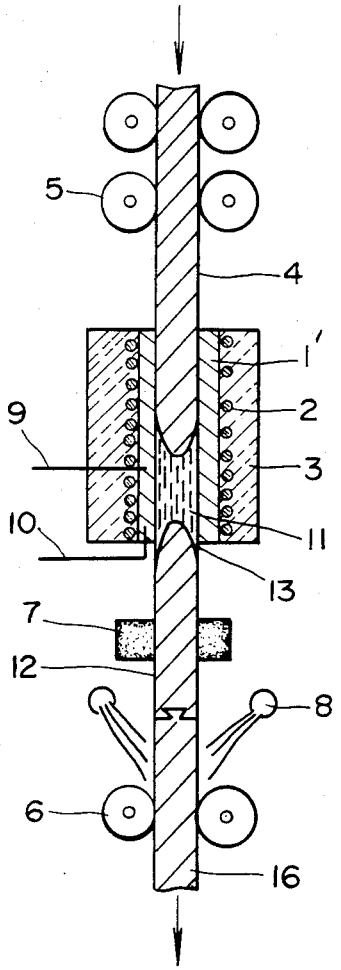
FIG. 4 is a view similar to FIG. 3, but showing another embodiment of this invention.
Figure 5:
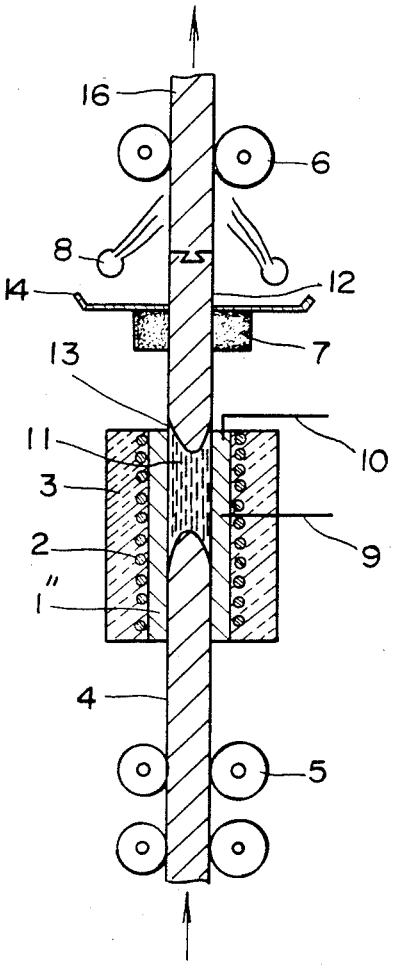
FIG. 5 is a view similar to FIG. 3, but showing still another embodiment of this invention.

According to this invention, the mold can be disposed horizontally or vertically, or at any appropriate angle therebetween so that the metallic material 4 may be moved horizontally or vertically, or at an angle therebetween. If the material is, for example, an alloy which is liable to segregation in the melting zone 11 due to a difference in specific gravity between its constituents, it is useful to use a vertically disposed mold as shown at 1' in FIG. 4 or at 1'' in FIG. 5 to pass the metallic material 4 downwardly or upwardly through the mold. This ensures the production of a metallic member 12 which is free from any substantial segregation. The apparatus shown in FIG. 4 further includes a receptacle 14 for receiving any dropping cooling agent in the event it is a liquid.

If the metallic material is passed through the mold having between its melting zone and its outlet end an inner wall surface maintained at a temperature which is higher than that of the material, it is possible to prevent completely the nucleation of any new crystal on the inner wall surface of the mold. Therefore, the number of the crystals composing the metallic member formed by the solidification of the melted material decreases as a result of the growth competition of those crystals, and there is eventually formed a metallic member which is composed of a single crystal. Thus, the method of this invention is not only suitable for producing a metallic member having a unidirectionally solidified structure, but also facilitates the production of a metallic member composed of a single crystal.

Figure 6:
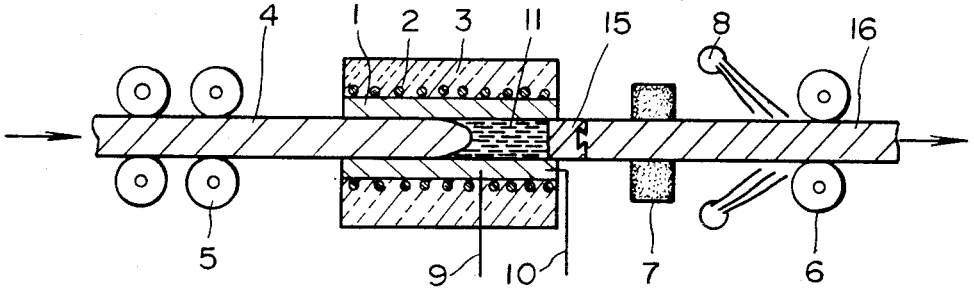
FIG. 6 is a view similar to FIG. 2, but showing a method of producing a metallic member composed of a single crystal.

Referring to FIG. 6, there is shown by way of example a method which facilitates the continuous production of a metallic member composed of a specifically oriented single crystal. A metallic material 4 is brought into contact with a dummy member 16 carrying a single seed crystal 15 at one end thereof facing the material 4. The mold 1 is heated to start the melting and solidification of the material 4 and the material 4 is moved in the direction of an arrow in FIG. 6.

When the method of this invention is carried out, it is advisable to ensure the intimate contact of the metallic material with the inner wall surface of the mold so that there may not be formed therebetween any clearance causing the molten material to leak out.

The mold may be formed from a heat resistant metal not reacting with the molten material, such as graphite or stainless steel, if the material to be treated is a low-melting one, such as tin or a lead alloy. If it is a high-melting material, such as aluminum, copper or an iron alloy, the mold may be formed from silicon carbide or nitride, boron nitride, alumina, magnesia, zirconia, or any other refractories not reacting with the molten oxide of the metal composing the material to be treated.

In order to prevent the oxidation of the melted metallic material when producing metallic member having a high melting point, it is effective to employ in the mold a protective gas atmosphere which can, for example, be formed by introducing an inert gas, such as argon or nitrogen, or a reducing gas, such as hydrogen or carbon monoxide.

If the metallic material has an oxide film on its surface, it is likely to corrode the inner wall surface of the mold in its melting zone. Therefore, it is advisable to remove any such oxide film by employing a gas to reduce the oxide or grinding the surface of the material immediately before it is fed into the mold.

If the material is particularly easily oxidizable, it is effective to keep it at a sufficiently low temperature not to cause any oxidation thereof, or hold it in an inert or reducing gas atmosphere so that the heat of the mold may not cause any oxidation of the material before it is fed into the mold.

The resistance heater may, for example, be of nichrome wire or silicon carbide if the material to be treated is a low-melting temperature metal, such as tin, zinc or lead, or aluminum. If it is a high-melting temperature metal, the heater may be formed from, for example, tantalum, tungsten, molybdenum, platinum or silicon carbide. The resistance heater can be replaced by a high-frequency induction coil, as hereinbefore stated.

The method of this invention is primarily capable of producing a metallic member having a structure which differs from that of the material fed into the mold, but a cross sectional shape which is identical to that of the material. According to this invention, however, it is also possible to produce continuously a metallic member having any desired cross sectional shape differing from that of the material if the outlet end of the mold adjacent to which the melting zone is established is formed with an appropriate cross sectional shape, and if the speed at which the material is moved at the inlet end of the mold and the speed at which the member formed therefrom is moved at the outlet end of the mold are so established that the member leaving the mold may always be of the same volume as that of the material entering it.

As the inner wall surface of the mold is held at a temperature which is higher than the solidifying temperature of the molten material, the metallic member being formed therefrom has a rounded solidifying end, since the molten material close to the inner wall surface of the mold does not solidify. Therefore, it is possible to produce a metallic member of high quality which is free from any fine cavity, blowhole or macroscopic segregation that may have existed in the material entering the mold.

The method of this invention is an epoch-making one for producing a material which is required to have a unidirectionally solidified structure, such as a magnetic material. It can not only improve the crystal structure of a metallic material prepared by the plastic working of a conventionally cast ingot if the material is merely passed through a mold having a melting zone. It is also a very effective method for the preliminary treatment of a metallic material which is used for making a very thin metal wire or foil. The production of a very thin wire or foil has hitherto required a complicated process including a repeated cycle of ingot annealing and plastic working and consuming a large amount of energy. This invention enables a drastic reduction in the work for any such heat treatment, since it can easily convert a metallic material prepared from a conventionally cast ingot to a member having a unidirectionally solidified structure and hence a high degree of workability. For example, the inventor of this invention has found that a sheet of tin produced by the method of this invention and having a thickness of 6 mm and a width of 10 mm can be worked to a thickness of 8 microns without requiring any heat treatment, and it has also been able to work a 20 mm dia. rod of an aluminum alloy containing 1% of silicon into a fine wire having a diameter of 30 microns without heat treating it at all.

The invention will now be described more specifically with reference to several examples thereof.

EXAMPLE 1

A 6 mm dia. rod of 99.9% purity tin having a circular cross section and a unidirectionally solidified structure was produced by employing a horizontally disposed hollow heating mold, as will hereunder be described. The mold was a graphite tube having an inside diameter of 6 mm, an outside diameter of 12 mm and a length of 100 mm and surrounded by a heater comprising a coil of nichrome wire. An alumel-chromel thermocouple was provided in the vicinity of the outlet end of the mold, and another alumel-chromel thermocouple in its melting zone, for measuring the temperature of the inner wall surface of the mold.

A rod of polycrystalline tin prepared by plastic working and having a diameter of 6 mm was placed through the mold by pinch rolls. An electric current was supplied to the heater to heat the mold, while water was being sprayed onto the surface of the rod at a rate of 100 cc per minute by a spray cooling device disposed at a distance of 20 mm from the outlet end of the mold. The electric current was so controlled that the mold might have a temperature of 240° C. in the vicinity of its outlet end and a temperature of 260° C. in the vicinity of its inner wall surface in the melting zone. The pinch rolls were rotated to pass the rod through the mold at a speed of 100 mm per minute. Thus, it was possible to produce continuously a rod or member of tin having a unidirectionally solidified structure, a shape which was identical to that of the original rod, and a very beautiful mirror surface.

Although a multiplicity of crystals not specifically oriented had been found in the original rod, the rod leaving the mold was found to be composed of ten longitudinally oriented crystals at a distance of 200 mm from its solidifying end and only a single crystal at a distance of 500 mm therefrom.

EXAMPLE 2

A 6 mm dia. rod of a Pb-5% Sn alloy having a circular cross section and a unidirectionally solidified structure was produced by employing a vertically disposed hollow heating mold through which the material was passed downwardly. The mold was a graphite tube having an inside diameter of 6 mm, an outside diameter of 12 mm and a length of 100 mm and surrounded by a heater comprising a coil of nichrome wire. An alumel-chromel thermocouple was provided in the vicinity of the outlet end of the mold, and another alumel-chromel thermocouple in its melting zone, for measuring the temperature of the inner wall surface of the mold.

The starting material was a rod of a polycrystalline Pb-5% Sn alloy prepared by plastic working and having a diameter of 6 mm. It was placed through the mold by pinch rolls. An electric current was supplied to the heater to heat the mold, while water was being sprayed onto the surface of the rod at a rate of 100 cc per minute by a spray cooling device disposed at a distance of about 20 mm from the outlet end of the mold. The electric current was so controlled that the mold might have a temperature of 320° C. in the vicinity of its outlet end and a temperature of 350° C. in the vicinity of its inner wall surface in the melting zone. The pinch rolls were rotated to pass the rod downwardly through the mold at a speed of 100 mm per minute. Thus, it was possible to produce continuously a rod or member of the Pb-5% Sn alloy having a unidirectionally solidified structure, a shape which was identical to that of the original rod, and a very beautiful mirror surface.

Although a multiplicity of crystals not specifically oriented had been found in the original rod, the rod leaving the mold was found to be composed of eight longitudinally oriented crystals at a distance of 200 mm from its solidifying end and only a single crystal at a distance of 700 mm therefrom.

EXAMPLE 3

A 4 mm thick, 20 mm wide sheet of 99.9% purity zinc having a unidirectionally solidified structure was produced by employing a horizontally disposed hollow heating mold. The mold was a graphite mold having an inside height of 4 mm, an inside width of 20 mm, an inside length of 100 mm and a wall thickness of 3 mm, and surrounded by a heater comprising a coil of nichrome wire. An alumel-chromel thermocouple was provided in the vicinity of the outlet end of the mold, and another alumel-chromel thermocouple in its melting zone, for measuring the temperature of the inner wall surface of the mold.

A polycrystalline zinc sheet prepared by plastic working and having a thickness of 4 mm and a width of 20 mm was placed through the mold by pinch rolls. The mold was heated, while water was being sprayed onto the surface of the sheet at a rate of 60 cc per minute by a spray cooling device disposed at a distance of 40 mm from the outlet end of the mold. The electric current supplied to the heater was so controlled that the mold might have a temperature of 425° C. in the vicinity of its outlet end and a temperature of 450° C. in the vicinity of its inner wall surface in the melting zone. The pinch rolls were driven to move the sheet through the mold at a speed of 100 mm per minute. As a result, there was continuously produced a sheet of zinc having a unidirectionally solidified structure, a shape which was identical to that of the original sheet, and a very beautiful mirror surface.

Although a multiplicity of crystals not oriented in any specific pattern had been found in the original sheet, the sheet leaving the mold was found to be composed of 15 longitudinally oriented crystals at a distance of 200 mm from its solidifying end and only a single crystal at a distance of 1000 mm therefrom.

EXAMPLE 4

An 8 mm dia. rod of an Al-1% Si alloy having a circular cross section and a unidirectionally oriented structure was produced by employing a horizontally disposed hollow heating mold. The mold was a silicon carbide tube having an inside diameter of 8 mm, an outside diameter of 12 mm and a length of 200 mm and surrounded by a coil of nichrome wire defining a heater. An alumel-chromel thermocouple was provided in the vicinity of the outlet end of the mold, and another alumel-chromel thermocouples in its melting zone, for measuring the temperature of the inner wall surface of the mold.

A rod of a polycrystalline Al-1% Si alloy prepared by plastic working and having a diameter of 8 mm was placed through the mold by pinch rolls. An electric current was supplied to the heater to heat the mold, while water was being sprayed onto the surface of the rod at a rate of 500 cc per minute by a spray cooling device disposed at a distance of 40 mm from the outlet end of the mold. The electric current was so controlled that the mold might have a temperature of 700° C. in the vicinity of its outlet end and a temperature of 750° C. in the vicinity of its inner wall surface in the melting zone. The pinch rolls were driven to move the rod through the mold at a speed of 100 mm per minute. As a result, there was continuously produced a rod or member of the alloy having a unidirectionally solidified structure, a shape which was identical to that of the original rod, and a very beautiful mirror surface.

Although a multiplicity of crystals not oriented in any particular pattern had been found in the original rod, the rod leaving the mold was found to be composed of 15 longitudinally oriented crystals at a distance of 300 mm from its solidifying end and only a single crystal at a distance of 1000 mm.

EXAMPLE 5

A 6 mm dia. rod of copper having a circular cross section and a unidirectionally solidified structure was produced by employing a horizontally disposed hollow heating mold. The mold was a graphite tube having an inside diameter of 6 mm, an outside diameter of 12 mm and a length of 200 mm and surrounded by a coil of nichrome wire defining a heater. An alumel-chromel thermocouple was provided in the vicinity of the outlet end of the mold, and another alumel-chromel thermocouple in its melting zone, for measuring the temperature of the inner wall surface of the mold.

A polycrystalline copper rod prepared by plastic working and having a diameter of 6 mm was placed by pinch rolls through the mold disposed in a protective nitrogen gas atmosphere. An electric current was supplied to the heater to heat the mold, while water was being sprayed onto the surface of the rod at a rate of 100 cc per minute by a spray cooling device disposed at a distance of 50 mm from the outlet end of the mold. The electric current was so controlled that the mold might have a temperature of 1100° C. in the vicinity of its outlet end and a temperature of 1180° C. in the vicinity of its inner wall surface in the melting zone. The pinch rolls were driven to move the rod through the mold at a speed of 100 mm per minute. As a result, there was continuously produced a rod of copper having a unidirectionally solidified structure, a shape which was identical to that of the original rod, and a very beautiful mirror surface.

Although a multiplicity of crystals not oriented in any particular pattern had been found in the original rod, the rod leaving the mold was found to be composed of ten longitudinally oriented crystals at a distance of about 100 mm from its solidifying end and only a single crystal at a distance of 500 mm therefrom.

What is claimed is:

1. A method of producing a metallic member having a unidirectionally solidified structure, which comprises passing a solid elongated metallic member progressively through a heating mold having a length less than the length of said member and its mold surfaces in contact with the corresponding section of the internal surfaces of said member, heating said mold to a sufficient temperature above the melting point of said member as to convert a lengthwise segment of said member entirely into molten condition which molten segment progressively moves along the member length as the member moves through the mold, and applying cooling to said member at a locus spaced from said mold in the direction of movement of said member at a rate sufficient to solidify the thus-liquified section as the same passes beyond said heated mold section so that the member undergoes solidification upon exiting from said heating mold.

2. The method of claim 1 wherein said heating mold has an exit opening through which the member leaves the same and including the step of controlling the rate of cooling relative to the rate at which the heated section of said mold is heated so that the exterior surfaces of said member become solid substantially simultaneously with their egress through such exit opening.

3. The method of claim 2, wherein the rates of heating and cooling are so coordinated that the interface generated between the molten and solidified sections of said member is concavo-convexly curved, defining a convexly curved solidified end projecting into the interior of said mold through said exit opening and a concavely curved liquified end having molten surface regions extending to said exit opening.

4. A method as set forth in claim 3, wherein at the exit end of said mold, said material is brought into contact with a dummy carrying a single seed crystal at one end thereof.

5. A method as set forth in claim 1, wherein said metallic member is composed of a single crystal.

6. A method as set forth in claim 1, wherein said mold is disposed horizontally or at an angle to the horizontal.

7. A method as set forth in claim 1, wherein said mold is disposed vertically.

8. A method as set forth in claim 6, wherein said member is passed downwardly through said mold.

9. A method as set forth in claim 7, wherein said member is passed upwardly through said mold.

10. A method as set forth in claim 1, wherein said mold is disposed in an inert or reducing gas atmosphere.

11. A method as set forth in claim 1, wherein said material is easily oxidizable and cooled until it is passed into said mold.

12. A method as set forth in claim 1, wherein said material has its surface reduced or ground before it is passed into said mold.

13. A method as set forth in claim 1, wherein said mold is heated by a resistance heater or a high-frequency induction coil.

14. A method as set forth in claim 1, wherein said mold is formed from a heat resistant metal or refractories which are unreactive with said material when said material is melted.

* * * * *

UNITED STATES PATENT AND TRADEMARK OFFICE

CERTIFICATE OF CORRECTION

PATENT NO. : 4,665,970

DATED : May 19, 1987

INVENTOR(S) : Atsumi Ohno

It is certified that error appears in the above-identified patent and that said Letters Patent is hereby corrected as shown below:

In the claims:

Column 10, line 5, "6" should read -- 7 --.

Signed and Sealed this

Eleventh Day of August, 1987

*Attest:*

DONALD J. QUIGG

*Attesting Officer*

*Commissioner of Patents and Trademarks*